US006480079B1

(12) United States Patent
Bentley et al.

(10) Patent No.: US 6,480,079 B1
(45) Date of Patent: Nov. 12, 2002

(54) ELECTRICAL CIRCUIT BREAKER DEVICE

(75) Inventors: William J. Bentley, North Attleboro, MA (US); Eric W. Morrison, Pawtucket, RI (US); Christian V. Pellon, Norton, MA (US); Nicholas V. Pellon, Norton, MA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/132,559

(22) Filed: Apr. 25, 2002

(51) Int. Cl.[7] ..... H01H 3/32; H01H 9/30; H01H 33/00

(52) U.S. Cl. ..... 335/6; 335/191; 200/401

(58) Field of Search ..... 335/6, 16, 189, 335/190, 191; 200/401

(56) References Cited

U.S. PATENT DOCUMENTS 4,057,716 A * 11/1977 Canonne et al. ..... 200/322
4,827,233 A 5/1989 Cobb, III
4,837,545 A 6/1989 Cobb, III et al.

* cited by examiner

*Primary Examiner*—Ramon M. Barrera
(74) *Attorney, Agent, or Firm*—Russell E. Baumann; Frederick J. Telecky, Jr.

(57) ABSTRACT

An electric circuit breaker (10) has a toggle mechanism (18) having two movable over center joints (3, 4) connected between a push-button (16) and a movable contact mechanism (30). When the push-button is depressed a first link rotates bringing the first movable over center joint (3) across a center position represented by a first imaginary straight line (1) to a stop surface (28). A spring member (36) provides a bias which acts on the second movable over center joint (4) normally maintaining the second movable joint against the stop surface so that with the two movable over center joints biased against the stop surface the movable contact mechanism is moved to a closed contact position when the push-button is depressed. An overload responsive member transfers motion to the second movable over center joint (4) upon the occurrence of a selected overload and moves the second over center joint across a center position represented by a second imaginary straight line (2) allowing the contacts opening spring (34) to move the movable contact mechanism to the open contacts position providing a trip free operation. The circuit breaker can be formed for a single phase or it can be formed for multiphase operation in which additional ganged phases have no toggle mechanism but do have separate ambient temperature compensated trip arms and overload responsive members which operate through the single toggle mechanism.

13 Claims, 8 Drawing Sheets

ELECTRICAL CIRCUIT BREAKER DEVICE

FIELD OF THE INVENTION

This invention relates generally to electrical circuit breakers and more particularly to such interrupters used as aircraft circuit breakers.

BACKGROUND OF THE INVENTION

It is conventional for aircraft circuit breakers to have an overload responsive member such as a current carrying bimetal, typically called a bimetal trip arm, which has a portion which deflects with changes in temperature to move a slidably mounted connecting plate which is adapted to engage and displace a trip arm. One part of a latch mechanism is movable with the trip arm and upon occurrence of an overload the one part of the latch mechanism is separated from a catch portion which allows a collapsible linkage mechanism to move a movable contact into an open contacts position. Such a device is shown, by way of example, in U.S. Pat. Nos. 4,827,233 and 4,837,545, assigned to the assignee of the present invention, the disclosure of which is included a herein by this reference. Typically a high localized contact force exists between the interengaging surfaces of the latch and its catch. Such surfaces are manufactured so that they are extremely smooth and wear resistant, using expensive materials thereby increasing component costs. Although such devices are effective, the friction of the latching mechanism tends to change over time introducing variability and can eventually change the calibration of the circuit breaker. Additionally, such devices require a relatively large number of components, particularly in multiphase breakers where several contact, linkage and latch mechanisms are ganged together.

SUMMARY OF THE INVENTION

It is an object of the invention to provide circuit breaker free of the prior art limitations noted above. Another object of the invention is the provision of an electrical circuit breaker which performs the same functions as conventional aircraft circuit breakers yet has no latch mechanism with concomitant friction. Yet another object of the invention is to provide an electrical circuit breaker which is trip free, can be made for use with single phase or multiphase applications and which has fewer parts and less weight than prior art devices.

Briefly, an electrical circuit breaker made in accordance with the invention comprises a housing in which a stationary electrical contact and a movable contact mechanism having a movable electrical contact are mounted with the movable electrical contact being movable between contacts open and closed positions. The movable contact mechanism is pivotably mounted and is provided with a first spring member urging the movable contact mechanism toward the open contacts position. A push-button is mounted on the housing and is connected to one end of a plurality of end to end interjointed link members with the opposite end connected to the movable contact mechanism.

The first link is rotatably connected to the housing at a location intermediate to the first and second ends of the link. One end of the first link is formed with a slot to receive therethrough a pin of the push-button for converting linear motion of the push-button to rotary motion of the first link. The second end of the first link forms a first movable over center joint and is pivotably connected to the first end of a second link. The second end of the second link forms a second movable over center joint and is in turn pivotably jointed to the first end of a third link whose second end is pivotably connected to the movable contact mechanism. A stop surface is disposed on one side of, and closely adjacent to, a first imaginary straight line extending through the rotational connection of the first link to the housing and the second movable over center joint and a second imaginary straight line extending through the first movable over center joint and the pivotable connection of the second end of the third link.

A second spring member biases the second movable over center joint toward the stop surface and when the push-button is depressed the first link is rotated against the bias of the first spring member moving the movable contact mechanism toward the contacts closed position with the first movable over center joint moving over center across the first imaginary line and into engagement with the stop surface essentially straightening out the several links and moving the movable contact mechanism into the closed contacts position.

An overload responsive trip member in the form of a current carrying bimetal trip arm is caused to deflect upon a selected overload current which deflection is transferred to a rotatably mounted ambient bimetal compensator. Rotation of the bimetal compensator transfers motion through a motion transfer portion of the bimetal compensator to the second movable over center joint moving it over center to the other side of the second imaginary line thereby allowing the first spring member acting on the movable contact mechanism to open the contacts. As long as the overload bimetal member is in the overload deflected position the circuit breaker can not be reset even with the push-button held in the depressed position.

According to a feature of the invention, the second movable over center joint is provided with a roller engageable with the stop surface to avoid sliding motion. According to another feature, the movable contact mechanism is preferably formed to provide a preload to obtain a desired level of contact force as by bending a spring member into a generally J-shaped configuration, mounting the movable electrical contact on a stiffened distal free end of the long leg and forming a lost motion pin connection between an intermediate location of the long leg and the distal end portion of the short leg of the J-shaped configuration. The movable contact mechanism is pivotably mounted to the housing adjacent the bight portion between the two legs so that when the third link transfers motion to the contact mechanism and closes the contacts, the pin rides in the slot with the spring member supplying the contact force. According to yet another feature, multiphase circuit breakers made in accordance with the invention have adjacent phase mechanisms which include corresponding contact mechanisms, overload responsive members and motion transfer connecting plates along with an arm of the ambient bimetal compensator but do not include additional toggle mechanisms thereby resulting in a decreased part count and device weight.

BRIEF DESCRIPTION OF THE DRAWINGS

The accompanying drawings, which are incorporated in and constitute a part of the specification, illustrate preferred embodiments of the invention and together with the description, serve to explain the objects, advantages and principles of the invention. In the drawings.

DETAILED DESCRIPTION OF PREFERRED EMBODIMENTS

Figure 1:
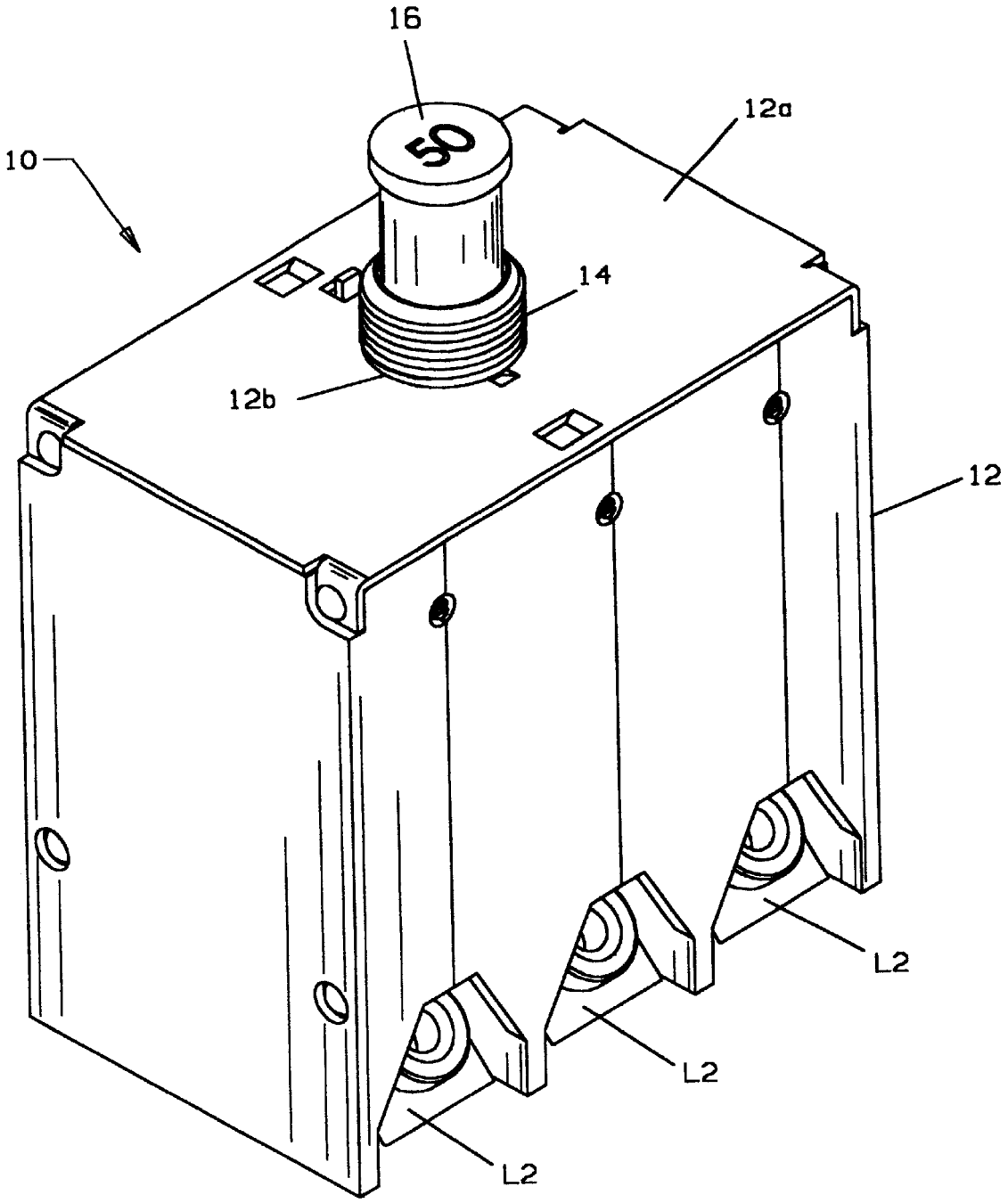
FIG. 1 is a perspective view of a three phase circuit breaker made in accordance with the invention.
Figure 2:
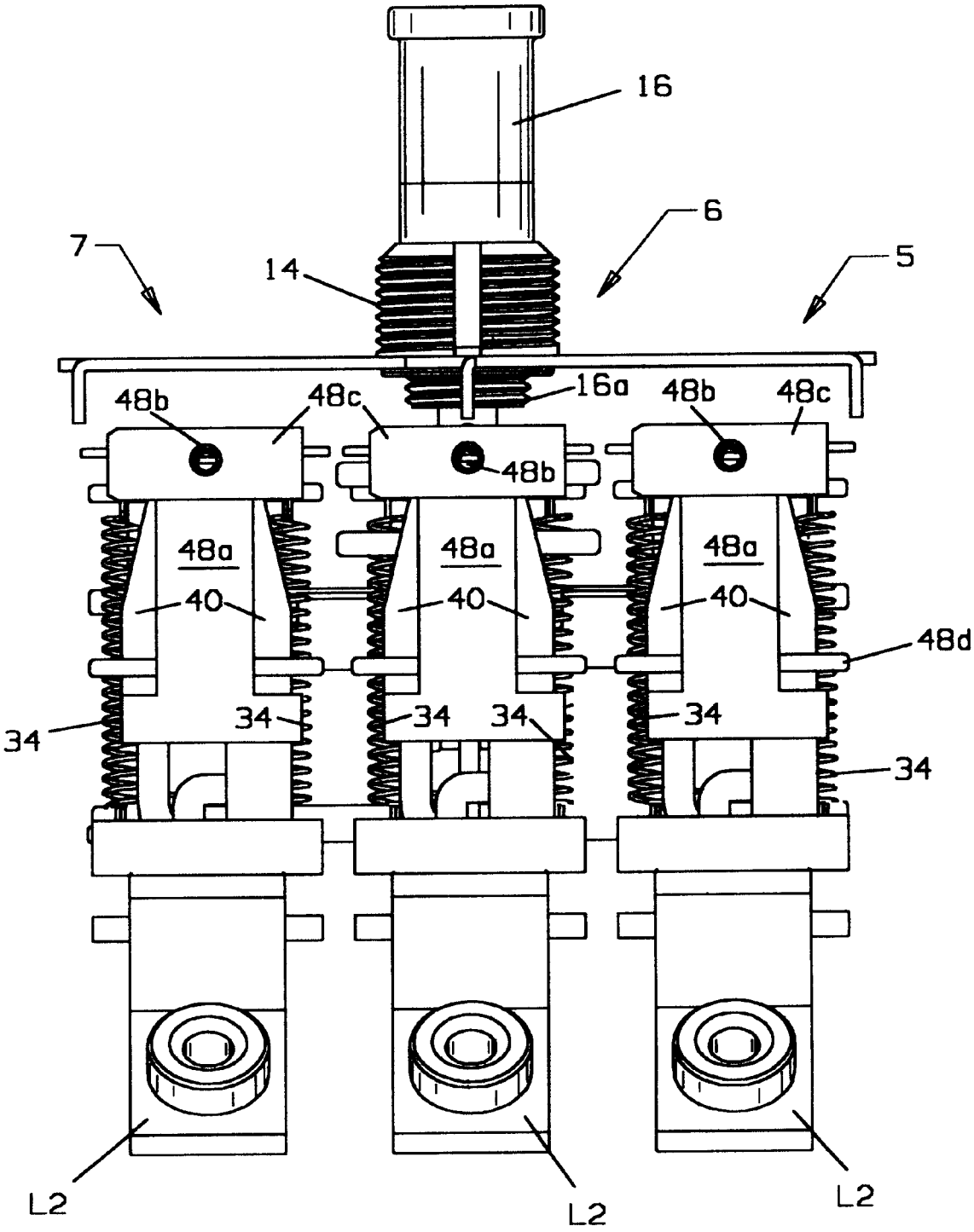
FIGS. 2 and 3 are front and rear elevational views of the FIG. 1 breaker shown with the housing broken away for purposes of illustration.
Figure 3:
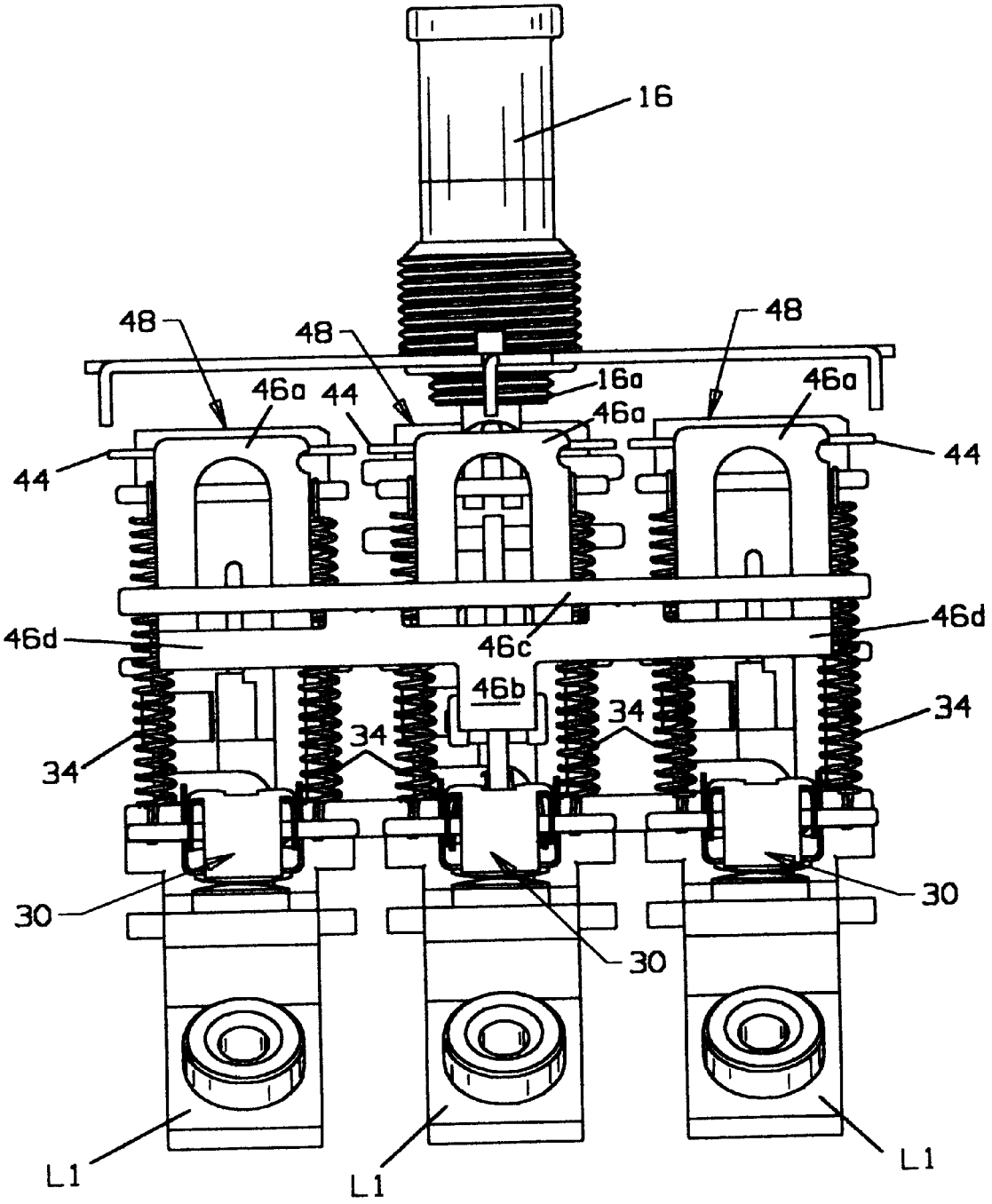
Figure 4:
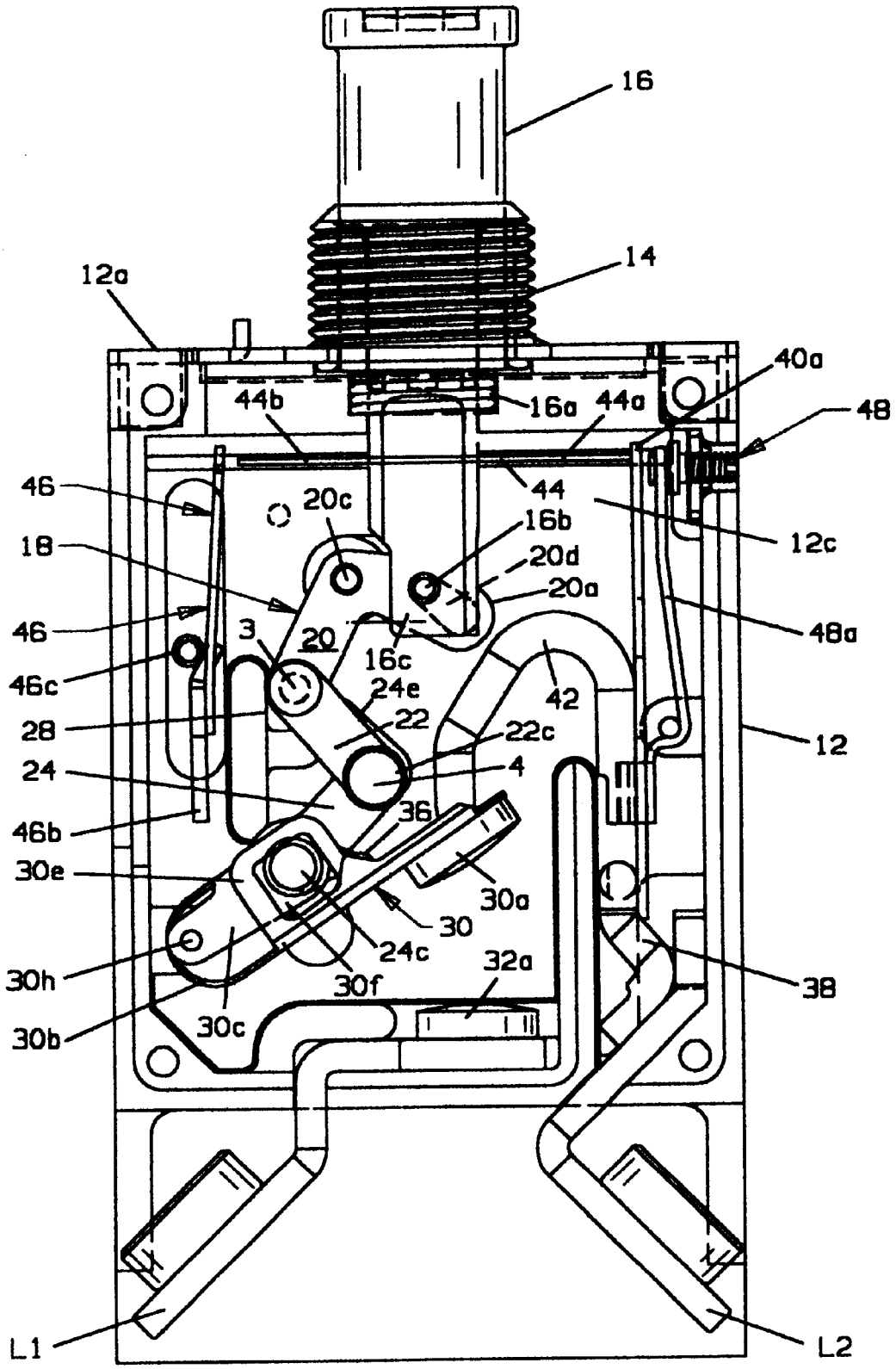
FIG. 4 is a side elevational view of the center phase of the FIG. 1 breaker shown without the front wall for purposes of illustration and shown with the push-button depressed and in the overload actuated, contacts open, trip free position.
Figure 5:
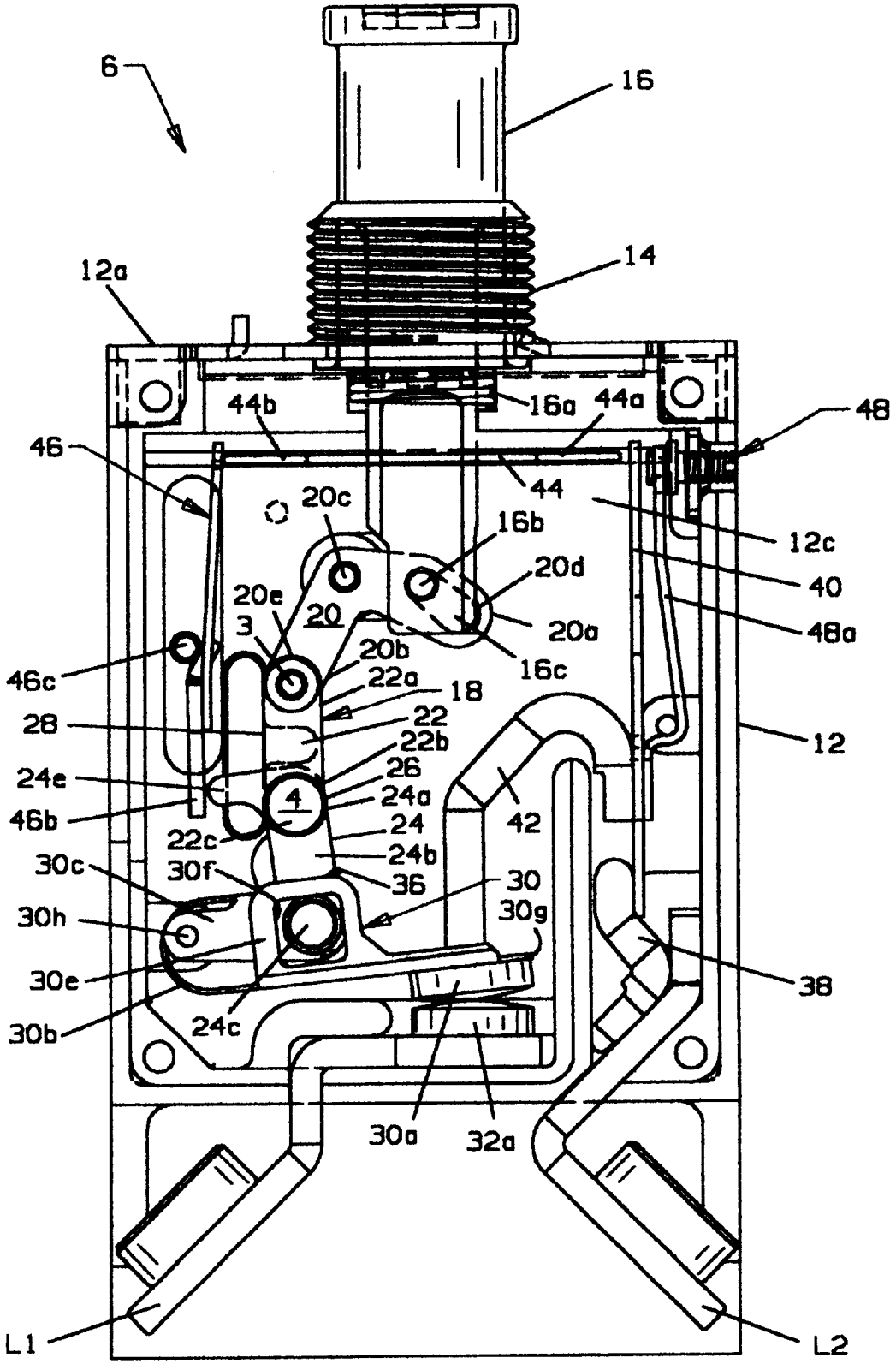
FIG. 5 is a view similar to FIG. 4 but shown in the contacts closed position.
Figure 6:
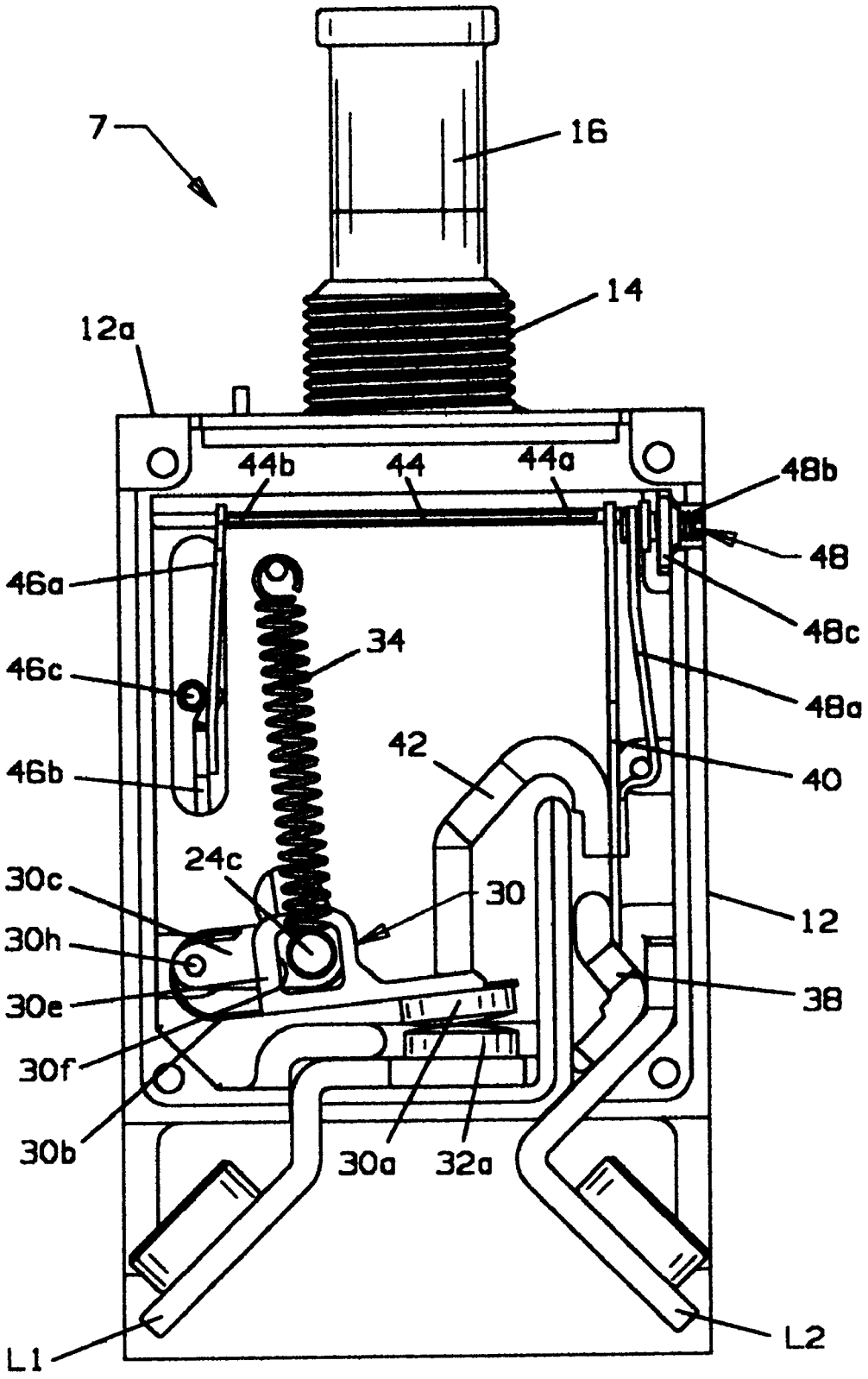
FIG. 6 is a view similar to FIG. 5 but showing an outer phase of a multiphase, ganged circuit breaker and shown with the push-button of the center phase.

Although the drawings show a three phase circuit breaker, breakers made in accordance with the invention can be of a single phase version having only the phase identified herein as the center phase, i.e., as shown in FIGS. 4 and 5, for example, or can be of the version for multiphase applications in which several phases are ganged together as shown in FIGS. 1–3, for example. In either case, an electrical circuit interrupter 10 made in accordance with a first embodiment of the invention comprises a housing 12 having a top wall 12*a* formed with an aperture 12*b* for receipt of a bushing 14 and a push-button 16. Push-button 16 is linearly movable between inner and outer positions as shown respectively in FIGS. 8 and 7. A push-button return spring 16*a* (see FIG. 4) is mounted within bushing 14 and places a force on the push-button toward the outer position. The bottom portion of the push-button is provided with a pin 16*b* which extends between spaced apart side portions 16*c* (one side portion being shown) for connection with one end of a toggle mechanism 18. Toggle mechanism 18 has a plurality of links 20, 22 and 24 jointed together in end to end fashion to form a chain. First link 20 has first and second ends 20*a*, 20*b* and is rotatably connected to side wall 12*c* of the housing by pin 20*c*. Pin 16*b* is received through a slot 20*d* adjacent end 20*a* of the first link, the slot preferably having a wider end furthest from the rotational connection to facilitate transition between linear motion of the push-button and rotational movement of link 20. Link 20 is generally L-shaped with the rotational connection offset from a straight line joining ends 20*a*, 20*b*. It should be understood that other configurations for the link can be employed as long as the actuating force, push-button 16 in the embodiment shown, acts in a direction which is not in line with the rotational connection of the link with the housing.

The second end 20*b* of first link 20 is pivotably connected at 20*b* to the first end 22*a* of second link 22 and forms a first movable over center joint 3. Second link 22 preferably is formed as a pair of overlying links members received on either side of first link 20 to allow uninhibited pivotal motion between the first and second link. The second ends 22*b* of second link members 22 receive therebetween and are pivotably connected to the first end 24*a* of third link 24 and form a second movable over center joint 4. Preferably, freely rotatable rollers 26 are mounted at the pivotable connection at ends 22*b* at movable joint 4 for rolling engagement with a stop surface 28 to be discussed. The second end 24*b* of third link 24 is pivotably connected to a movable contact mechanism 30. Movable contact mechanism 30 is pivotably connected to housing 12 at one end of the mechanism by pin 30*h*. Movable electrical contact 30*a* is movable into and out of electrical engagement with a stationary electrical contact 32*a* between respective contacts closed and open positions. Preferably, movable electrical contact 30*a* is provided with a preload as by forming the movable contact arm 30*b* out of a strip of suitable spring material and bending the strip back over itself to form a generally J-shaped configuration having two legs extending from a bight portion with one end on the upper, shorter leg formed with two spaced apart, downwardly extending legs 30*c* formed with pin receiving aperture 30*d* and two spaced apart, upwardly (after bending) extending legs 30*e* on the lower, longer leg having a generally vertically extending pin receiving slot 30*f* formed in each leg. The legs extending from the bight portion are rigidized as by turning over the outer side margins. A pin 24*c* is placed through the aperture, slots and an aperture in the second end 24*b* of third link 24. In the open contacts position, the spring strip causes the pin to move to the uppermost extremity of the slots and when the movable electrical contact mounted at the distal end 30*g* of the longer leg engages the stationary electrical contact the pin moves downwardly in the slots placing a selected force on the stationary electrical contact. The movable contact mechanism is pivotably mounted on pin 30*h* adjacent to the bight portion connecting the two legs.

Figure 7:
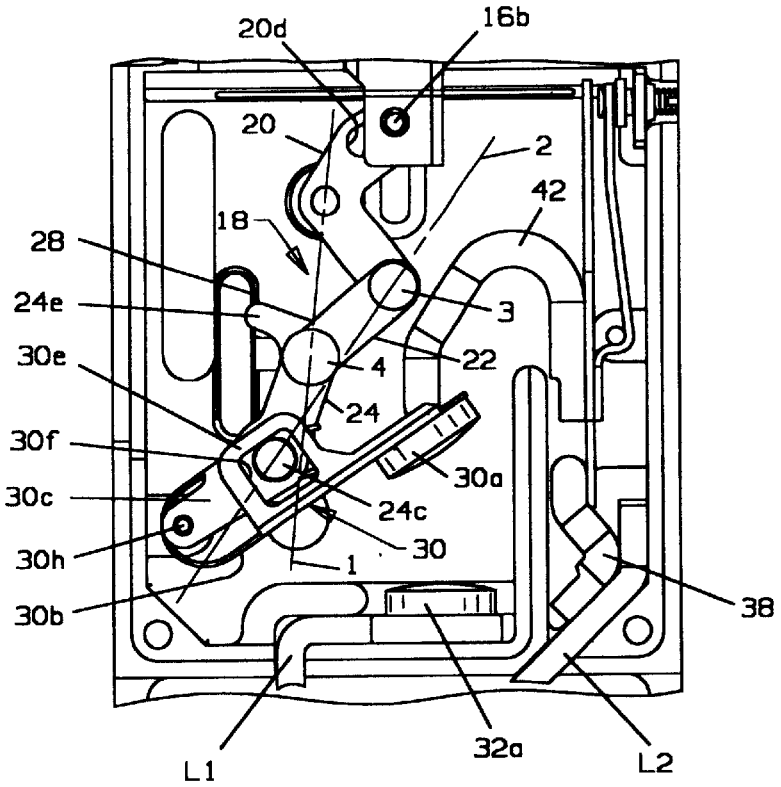
FIGS. 7–9 are broken away, somewhat simplified side elevational views showing the toggle mechanism in the open, cooled condition (FIG. 7), closed contacts position (FIG. 8) and open trip-free position with the push-button depressed (FIG. 9).
Figure 8:
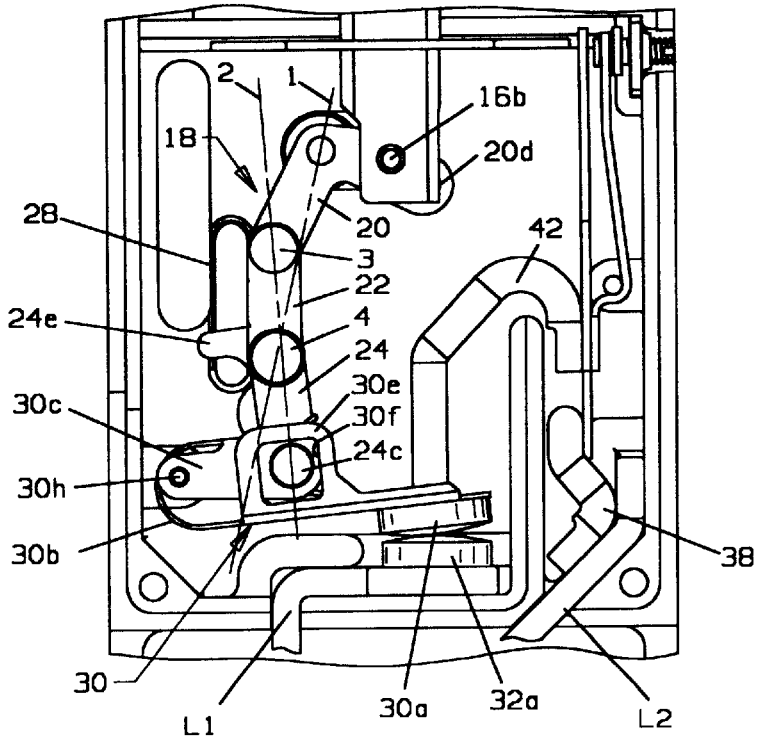
Figure 9:
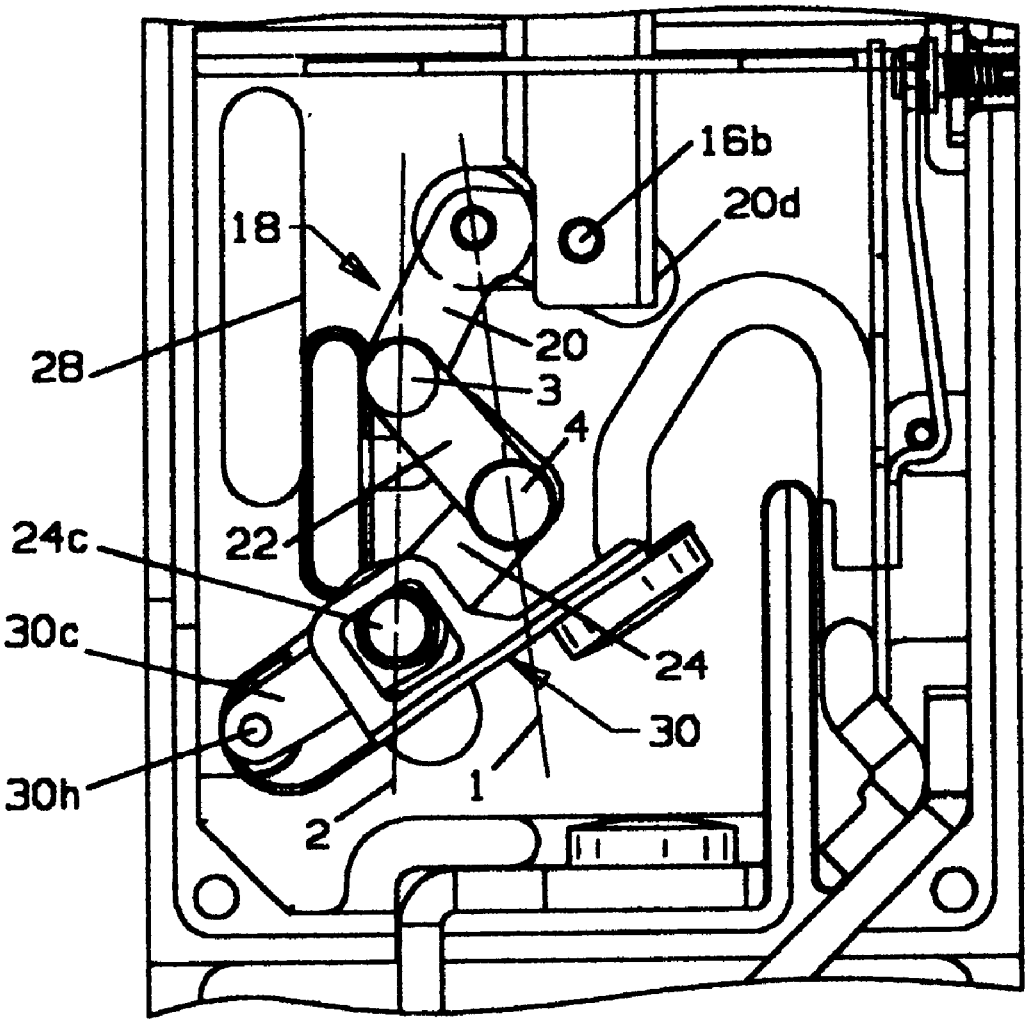

With particular reference to FIGS. 7–9, as push-button 16 is moved down or pulled up, first link 20 rotates about pin 20*c* with rivet 20*e* joining links 20, 22 forming a first movable over center joint 3 as mentioned above and being movable between opposite sides of an imaginary line 1 extending through pin 20*c* and rollers 26. A second movable over center joint 4 is formed at rollers 26 which is movable between opposite sides of an imaginary line 2 extending through over center joint 3 and pin 24*c* at second end 24*b* of third link 24.

A generally vertically extending stop surface 28 is formed in housing 12 and is placed so that it limits motion of first and second movable over center joints 3, 4 on one side of their respective imaginary lines closely adjacent thereto.

When push-button 16 is pulled outwardly, as shown in FIG. 7, link 20 is rotated (counterclockwise as seen in the drawing) so that movable over center joint 3 is moved away from stop surface 28 to the other side of imaginary line 1. First spring members 34 connected between movable contact mechanism 30 and a stationary portion of the breaker provide a bias to the movable contact mechanism, as well as the toggle mechanism, in the open contacts direction. Thus pulling the push-button outwardly opens the contacts. A second spring member, torsion spring 36, engages third link 24 reacting against pin 24*c*, and biases link 24 towards stop surface 28 to normally maintain second movable over center joint 4 on the stop surface side of imaginary line 2.

When push-button 16 is pushed inwardly as shown in FIG. 8, link 20 is rotated (clockwise as seen in the drawing) in the opposite direction against an increasing force of spring member 34 as it is stretched, tending to straighten the toggle mechanism until movable joint 3 passes a center point having a maximum resisting spring force when movable joint 3 is aligned with imaginary line 1, and then the movable joint snaps over to the stop surface 28.

With regard to a single phase circuit breaker discussed thus far, electrical circuit breaker 10, is connected to a circuit to be protected through terminals L1, L2. Terminal L1 mounts stationary electrical contact 32*a* and movable contact 30*a* is connected to load terminal L2 through an overload sensing mechanism to be described. A short current carrying wire or pigtail 38 is connected between terminal L2 and a current carrying bimetallic trip arm 40. Trip arm 40 is generally U-shaped with the end of one leg being fixedly mounted in housing 12 and connected to pigtail 38 and the end of the other leg being fixedly mounted in housing 12 and connected to a long, current carrying, flexible wire or pigtail 42 having an opposite end connected to movable contact assembly 30 and movable electrical contact 30*a*. The bight portion 40*a* of the trip arm is disposed adjacent one end 44*a* of a connecting plate 44 horizontally slidable in housing 12.

Ambient temperature compensation is provided in circuit breaker 10 by an ambient temperature bimetal compensator member 46. Member 46 has an upper deflectable compensator arm 46*a* in the form of a strip of bimetallic material and a lower, rigid motion transfer portion 46*b* having side walls or the like to provide rigidity and may be formed of bimetal as a one piece member if desired. Member 46 is mounted on rod 46*c* which is rotatably mounted in housing 12. The distal end of compensator arm 46*a* is disposed adjacent to end 44*b* of connecting plate 44, opposite to end 44*a*. A current overload in trip arm 40 will cause the bight portion thereof to deflect to the left as seen in the drawings resulting in opening of the contacts of the circuit breaker as will be explained below. However, a change in ambient temperature will cause both the bight portion of trip arm 40 and the distal free end of the upper compensator arm 46*a* to deflect similarly to maintain essentially the same spatial relationship therebetween.

A calibration assembly 48 comprising calibration arm 48*a*, calibration screw 48*a* and calibration plate 48*c* cooperate to allow adjustment of the circuit breaker to perform properly for given over currents and ambient temperatures. Plate 48*c* is fixedly mounted in housing 12 and screw 48*a* is received therethrough so that rotation of screw 48*a* can cause rotation of calibration arm 48*a* about pivot 48*d* which transfers motion through connecting plate 44 to rotate compensator arm 46*a* of ambient compensator member 46 a corresponding amount.

Third link 24 is preferably formed with extension 24e, adjacent to second movable over center joint 22*c* and extending toward motion transfer portion 46*b* of compensated trip member 46. When an overload occurs and bight 40*a* deflects to thereby move connecting plate 44, the connecting plate will cause bimetal compensator 46 to rotate counterclockwise as viewed in the drawings and transfer motion and force to extension 24*e* thereby moving the second movable joint 4 away from stop surface 28 and past the center, imaginary line 2, allowing spring member 34 to open the contacts.

Using the second movable over center joint to trip the circuit breaker results in a trip free device. That is, even if the push-button is held down in the depressed position as shown in FIGS. 4 and 9, motion transfer portion 24*e* prevents the second movable joint 4 from moving back over imaginary line 2. Both movable joints must on the stop surface side of their respective imaginary lines 1, 2 in order for the contacts to be in the closed contacts position.

In the above description a single phase has been described, however, it applies as well to a multiphase device in which devices for more than one phase are ganged together to protect two or more phases. In such a ganged device, the toggle mechanism and push-button remains the same for the phase described above with the devices for the other phases provided with similar tripping mechanisms cooperating through the single toggle mechanism. With reference to FIGS. 2 and 3 which show a circuit breaker having three ganged phase devices 5, 6 and 7, shown without housing 12, center phase 6 is the same as described above. Ambient temperature bimetal compensator member 46 has spaced apart compensator arms 46*a*, one aligned with each phase extending upwardly from transversely extending portion 46*d* with motion transfer portion 46*b* extending downwardly from the center compensator arm 46*a*. The compensator arms and transversely extending portion 46*d* are fixedly attached to rotatable rod 46*c*. Each phase is provided with a connecting plate 44, trip arm 40 and calibration mechanism 48 as in the center phase. Thus an overload in a trip arm 40 of any of the phases will cause the respective connecting plate to slide over and push the distal end portion of the respective upper compensator arm 46*a* causing rod 46*c* to rotate and in turn move motion transfer portion 46*b* which moves extension 24*e* of third link 24 and second movable over center joint 4 away from the stop surface 28 across imaginary line 2 to trip the circuit breaker to the open contacts position.

A circuit breaker made in accordance with the invention as described above does not have a latch mechanism as used in typical prior art devices which results in avoiding friction associated with latches and concomitant problems with changing frictional forces over time which adversely affect calibration of the device. In circuit breaker devices made in accordance with the invention in which a plurality of phases are ganged together, further advantages are obtained by reducing the complexity of the design and significantly decreasing the number of parts needed along with an accompanying savings in weight by virtue of employing only one toggle mechanism. The toggle mechanism movable over center joints provide repeatable operational forces while the reset and pull-out forces can be independently adjusted without affecting the trip of contact forces.

Although the invention has been described with regard to certain preferred embodiments thereof, variations and modifications will become apparent to those skilled in the art. For example, although a push-button is shown and described for rotating first link 20, other force applying members can be used if desired, such as a toggle or rocker mechanism, known in the art. The particular configurations and lengths of the several links of the toggle mechanism can be varied to provide different contact set and reset forces, amount of contact opening and the like. Further, the toggle mechanism of the invention can be used with other circuit interrupting devices such as thermostats for example. Various actuation mechanisms can be used such as solenoid, piezo, thermal, magnetic and the like. The movable contact mechanism can be pre-loaded as described, snap acting, spring loaded cantilever, dual contact and the like. It is, therefore, the intention that the appended claims be interpreted as broadly as possible in view of the prior art to include all such variations and modifications.

What is claimed:

1. An electric circuit breaker comprising a housing, a stationary electrical contact, a movable contact mechanism having a movable electrical contact movable into and out of electrical engagement with the stationary electrical contact between respective closed and open contact positions, a toggle mechanism, a first manual force applying member for applying a force to the toggle mechanism, a second condition responsive force applying mechanism for applying a force to the toggle mechanism upon the occurrence of the condition, the toggle mechanism comprising a plurality of links jointed together to form a chain having two opposite ends, one end being in force receiving relationship with the first force applying member and the other end being connected to the movable contact mechanism, the toggle mechanism having first and second over center mechanisms each having a center, two opposite sides of center and a movable joint movable between the two opposite sides, a stop surface limiting movement of the movable joints on one side of center, the movable joint of the first over center mechanism being movable to the one side of center by a force from the first force applying member and the second over center mechanism being movable to the other side of center by the second force applying member, the movable electrical contact being in engagement with the stationary electrical contact only when the movable joints of both the first and second over center mechanisms are on the said one side of center.

2. An electric circuit breaker according to claim 1 further comprising a spring member biasing the movable joint of the second over center mechanism toward the said one side of center.

3. An electric circuit breaker according to claim 1 further comprising a spring member biasing the movable contact toward an open contacts position.

4. An electric circuit breaker comprising a housing, a stationary electrical contact, a movable contact mechanism having a movable electrical contact movable between a contacts closed position in engagement with the stationary contact and an open contacts position out of engagement with the stationary electrical contact, a stop surface, a toggle mechanism having at least three links interconnected to form a chain, each link having first and second ends, a first link being pivotably connected to the housing at a location intermediate to the first and second ends thereof, the second end of the first link connected to the first end of the second link forming a first movable joint, the second end of the second link connected to the first end of the third link forming a second movable joint, the second end of the third link connected to the movable contact mechanism, the first movable joint being movable between first and second opposite sides of a first imaginary straight line extending through the pivotable connection of the first link to the housing and the second movable joint, the first movable joint being limited in movement in one direction on the first side of the first imaginary straight line by the stop surface at a location closely adjacent to the first imaginary straight line, and the second movable joint being movable between first and second opposite sides of a second imaginary straight line extending through the first movable joint and the second end of the third link, the second movable joint being limited in movement in one direction on the first side of the second imaginary straight line by the stop surface at a location closely adjacent to the second imaginary straight line, a first spring member biasing the second movable joint toward the first side of the second imaginary straight line, a first force applying member for applying a force to the first link to move the first movable joint against the stop surface and a second overload responsive member movable upon an overload to apply a tripping force to the linkage mechanism to move the second movable joint to the second side of the second imaginary straight line, the movable electrical contact being engageable with the stationary electrical contact only when the first and second movable joints are engaged with the stop surface on the first side of their respective imaginary straight lines.

5. An electric circuit breaker according to claim 4 further comprising a second spring member biasing the movable contact toward the open contacts position.

6. An electric circuit breaker according to claim 4 further comprising a push-button mounted in the housing and attached to the first end of the first link.

7. An electric circuit breaker according to claim 6 in which the first end of the first link is formed with a slot having a selected length, the slot having a width which increases along the length and the push-button is formed with a pin received in the slot for converting a linear motion of the push-button to a rotary motion of the first link.

8. An electric circuit breaker according to claim 4 further comprising a roller attached to the first movable joint for rolling engagement with the stop surface.

9. An electric circuit breaker according to claim 4 further comprising a current carrying bimetal cantilever mounted in the housing, the bimetal having a distal free end for engaging a motion transfer slide extending to the overload responsive member which is pivotably mounted in the housing.

10. An electric circuit breaker according to claim 9 in which the overload responsive member has first and second ends and is pivotably mounted at a location intermediate to its ends on a rod, the overload responsive member formed of bimetal to provide ambient compensation.

11. An electric circuit breaker according to claim 10 in further comprising at least one other stationary electrical contact and a movable contact mechanism associated therewith, and a separate current carrying bimetal and motion transfer member are mounted in the housing, and a bimetal overload responsive member having first and second ends has one end fixedly attached to the rod and movable with the rod, the motion transfer member engageable with the second end of the bimetal overload responsive member to turn the rod and transfer motion to the first overload responsive member to move the movable contact to the open contacts position.

12. An electrical circuit breaker according to claim 4 in which the movable contact mechanism includes a pivotable contact arm having first and second ends, the first end pivotably mounted to the housing and the second end mounting the movable contact, and a lost motion connection between the second end of the third link and the movable contact arm at a location intermediate to the ends of the movable contact arm, the movable contact arm including a spring member biasing the movable contact arm towards one extremity of the lost motion connection to provide a preload for the movable contact when in the contacts closed position.

13. An electrical circuit breaker comprising a housing, a stationary electrical contact, a movable contact mechanism having a movable electrical contact movable between a contacts closed position in engagement with the stationary contact and an open contacts position out of engagement with the stationary electrical contact, a toggle mechanism having at least three links pivotably connected together to form a chain, each link having first and second ends, the first link being pivotably connected to the housing at a location of the link intermediate to the first and second ends thereof, a first force applying member for applying a force to the first end of the first link and the second end of the first link jointed to the first end of the second link forming a first movable joint, the second end of the third link jointed to the movable contact mechanism and the first end of the third link jointed to the second end of the second link forming a second movable joint, a first imaginary straight line extending through the pivotable joint of the first link with the housing and the joint at the second end of the second link and a second imaginary straight line extending through the first movable joint and the joint at the second end of the third link, the movable joints being movable between positions on opposite sides of their respective imaginary straight lines, a stop surface limiting movement of the movable joints in one direction to a position on one side of their respective imaginary straight lines closely adjacent thereto, a second, condition responsive, force applying member for applying a force on the second movable joint in the direction toward the side of the respective imaginary straight line opposite to the stop surface, and the movable electrical contact being engageable with the stationary electrical contact only when both the first and second movable joints are engaged with the stop surface.

* * * * *